US007208690B1

(12) United States Patent
Kodani

(10) Patent No.: US 7,208,690 B1
(45) Date of Patent: Apr. 24, 2007

(54) ROTARY ELECTRONIC COMPONENT AND METHOD OF MANUFACTURING THE SAME

(75) Inventor: Takashi Kodani, Okayama (JP)

(73) Assignee: Matsushita Electic Industrial Co., Ltd., Osaka (JP)

( * ) Notice: Subject to any disclaimer, the term of this patent is extended or adjusted under 35 U.S.C. 154(b) by 0 days.

(21) Appl. No.: 11/518,152

(22) Filed: Sep. 11, 2006

(30) Foreign Application Priority Data

Oct. 14, 2005 (JP) ..... 2005-300021

(51) Int. Cl.
*H01H 3/08* (2006.01)

(52) U.S. Cl. ..... 200/336; 200/331

(58) Field of Classification Search .... 200/11 R–11 G, 200/564, 565, 568–571, 329, 330, 331, 336
See application file for complete search history.

(56) References Cited

U.S. PATENT DOCUMENTS 2,781,436 A * 2/1957 Barden ..... 338/202
3,594,529 A * 7/1971 Cartwright ..... 200/330
4,035,759 A * 7/1977 Van Benthuysen ..... 338/162
4,051,340 A * 9/1977 Wolski ..... 200/329
4,132,129 A * 1/1979 Pratt ..... 74/553
4,665,464 A * 5/1987 Vermeulen ..... 361/293
5,634,553 A * 6/1997 Hopper et al. ..... 200/336
6,288,351 B1 * 9/2001 Bruntz ..... 200/336

FOREIGN PATENT DOCUMENTS

JP 10-064375 3/1998

* cited by examiner

*Primary Examiner*—Michael A. Friedhofer
(74) *Attorney, Agent, or Firm*—Wenderoth, Lind & Ponack, L.L.P.

(57) ABSTRACT

The rotary electronic component contains a case for accommodating a functional element section, a rotary shaft supported by a bearing for actuating the functional element section, with the upper portion of the shaft upwardly protruding, and a length-adjusting shaft attached to the upper portion of the rotary shaft. The rotary electronic component further contains a fixing member with a linear section extending in a direction axially of the rotary shaft. The linear section is inserted between the rotary shaft and the length-adjusting shaft, whereby a secure connection between the two shafts is obtained.

11 Claims, 15 Drawing Sheets

ROTARY ELECTRONIC COMPONENT AND METHOD OF MANUFACTURING THE SAME

BACKGROUND OF THE INVENTION

1. Field of the Invention

The present invention relates to a rotary electronic component that constitutes an input operation section of electronic equipment and also relates to a method of manufacturing the electronic component.

2. Background Art

Hereinafter will be described a rotary encoder with a general-purpose structure as an example of a conventional rotary electronic component, with reference to drawings. FIG. 18 is a sectional view of a conventional rotary encoder. FIG. 19 shows an essential part of the encoder where a bearing and an operation shaft are being assembled.

Die-cast bearing 1 is attached to the upper portion of resin case 10. Die-cast operation shaft 2 formed into a rod shape has column section 2A that fits in round central hole 1A of bearing 1. Operation shaft 2 is rotatably held by the bearing and also movable in a direction axially of the shaft. Operation shaft 2 contains large-diameter section 2E in its upper portion and small-diameter section 2B in its middle. Small-diameter section 2B has C-shaped fixing ring 4 having a diameter larger than central hole 1A. Fixing ring 4 prevents operation shaft 2 from coming-off upwardly.

Operation shaft 2 fits in central hole 1A from the upper side of bearing 1 as shown in FIG. 19, and then operation shaft 2 is fixed by fixing ring 4 that is inserted onto the shaft from the lower side of bearing 1 and settles at small-diameter section 2B as shown in FIG. 18.

Operation shaft 2 has non-circular (in cross-section) area 2C in its lower portion. Rotator 6 of encoder 5 has an engagement with non-circular area 2C. Rotation of non-circular area 2C is carried to rotator 6, whereas movement in an axial direction of non-circular area 2C is not carried to rotator 6. Tip 2D of operation shaft 2 is in contact with movable contact 8 with springiness in push-switch section 7. Thus movable contact 8 urges operation shaft 2 upwardly, and accordingly, fixing ring 4 has an intimate contact with the periphery of central hole 1A of bearing 1.

Spring 9 is fixed under bearing 1 in a manner that a downwardly extending elastic arm of spring 9 elastically contacts an unevenness section that is radially formed on the upper surface of rotator 6. Spring 9 produces not only a torque during the rotation of rotator 6 but also a clicking feeling in response to a rotary operation through a predetermined angle.

To use such a conventional rotary encoder with a push switch as described above, knob 3 is disposed on large-diameter section 2E at the upper portion of operation shaft 2. When a user rotates knob 3 to rotate operation shaft 2, rotator 6 is also rotated. The rotation allows encoder 5 to generate a pulse signal, which is obtained via terminals 10A and 10B. When the user pushes operation shaft 2 by pushing down knob 3, electrical connections are established between terminals 8A in push-switch section 7. Such a rotary encoder is disclosed in, for example, Japanese Patent Unexamined Publication No. H10-64375.

Such a conventional rotary electronic component (i.e., a rotary encoder) is employed for an input operation section of electronic equipment. However, the structure of the input operation section varies depending on the equipment; in particular, the height between knob 3 and the wiring board on which the rotary electronic component is mounted varies depending on the structure of each input operation section.

Accordingly, the length of operation shaft 2 has to be changed so as to fit with each structure of the electronic equipment.

SUMMARY OF THE INVENTION

A rotary electronic component of the present invention has a functional element section, a case for accommodating the functional element section, a rotary shaft for operating the functional element section, a bearing, a length-adjusting shaft, and a fixing member. The bearing, which is fixed to the case, retains the rotary shaft. The length-adjusting shaft is attached to the upper portion of the rotary shaft protruding from the bearing. The fixing member has a linear section that extends along a direction parallel to a rotational axis of the rotary shaft. The fixing member holds the rotary shaft and the length-adjusting shaft in a manner that the linear section is positioned between the rotary shaft and the length-adjusting shaft. The structure above accepts a length-adjusting shaft with a length suitable for equipment on which the rotary electronic component is mounted. This contributes to a shortened delivery time. At the same time, a wide variety of rotary electronic components with different shaft lengths can be easily produced.

DETAILED DESCRIPTION OF THE INVENTION

First Exemplary Embodiment

Figure 1:
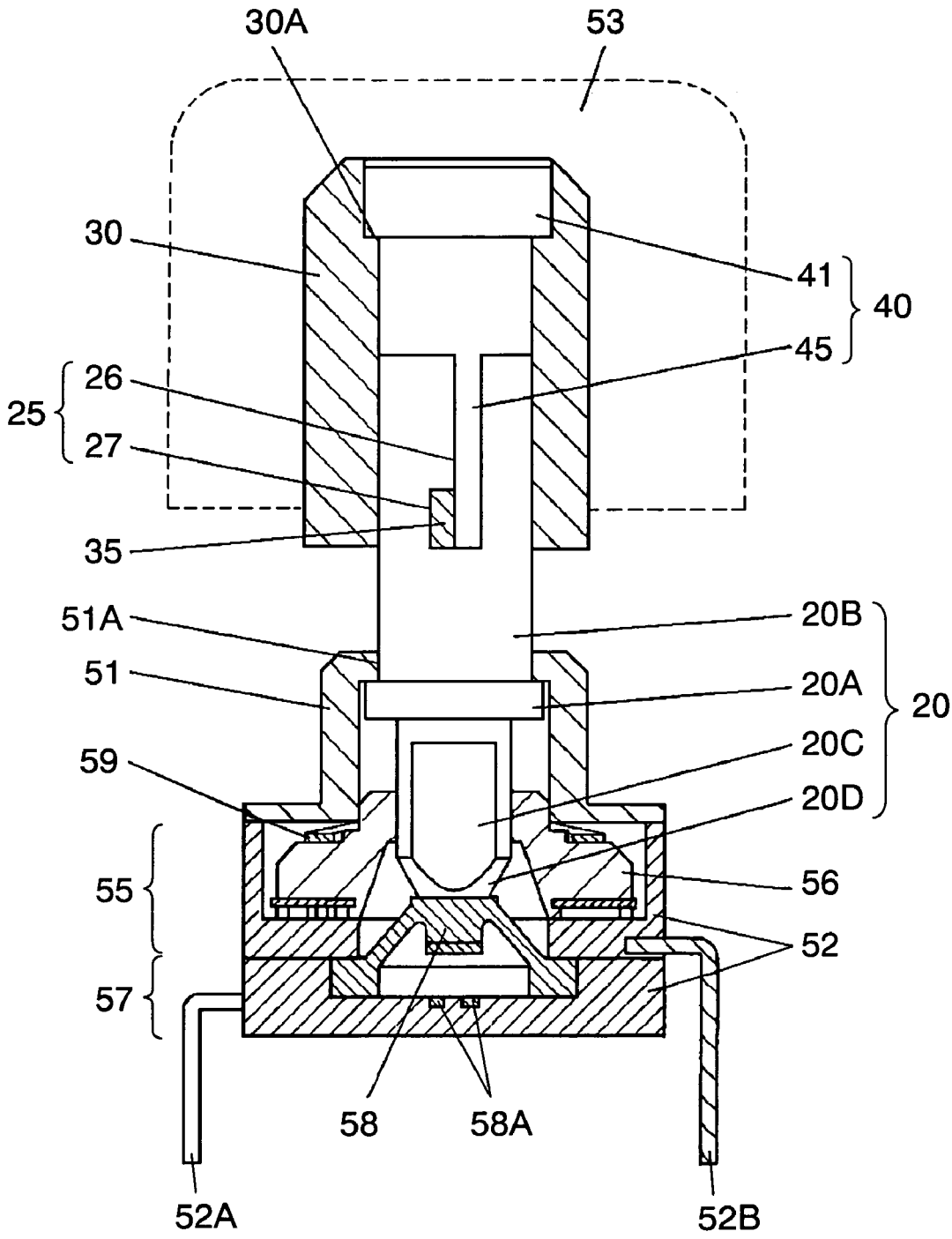
FIG. 1 is a sectional view of a rotary encoder in accordance with a first exemplary embodiment of the present invention.
Figure 2:
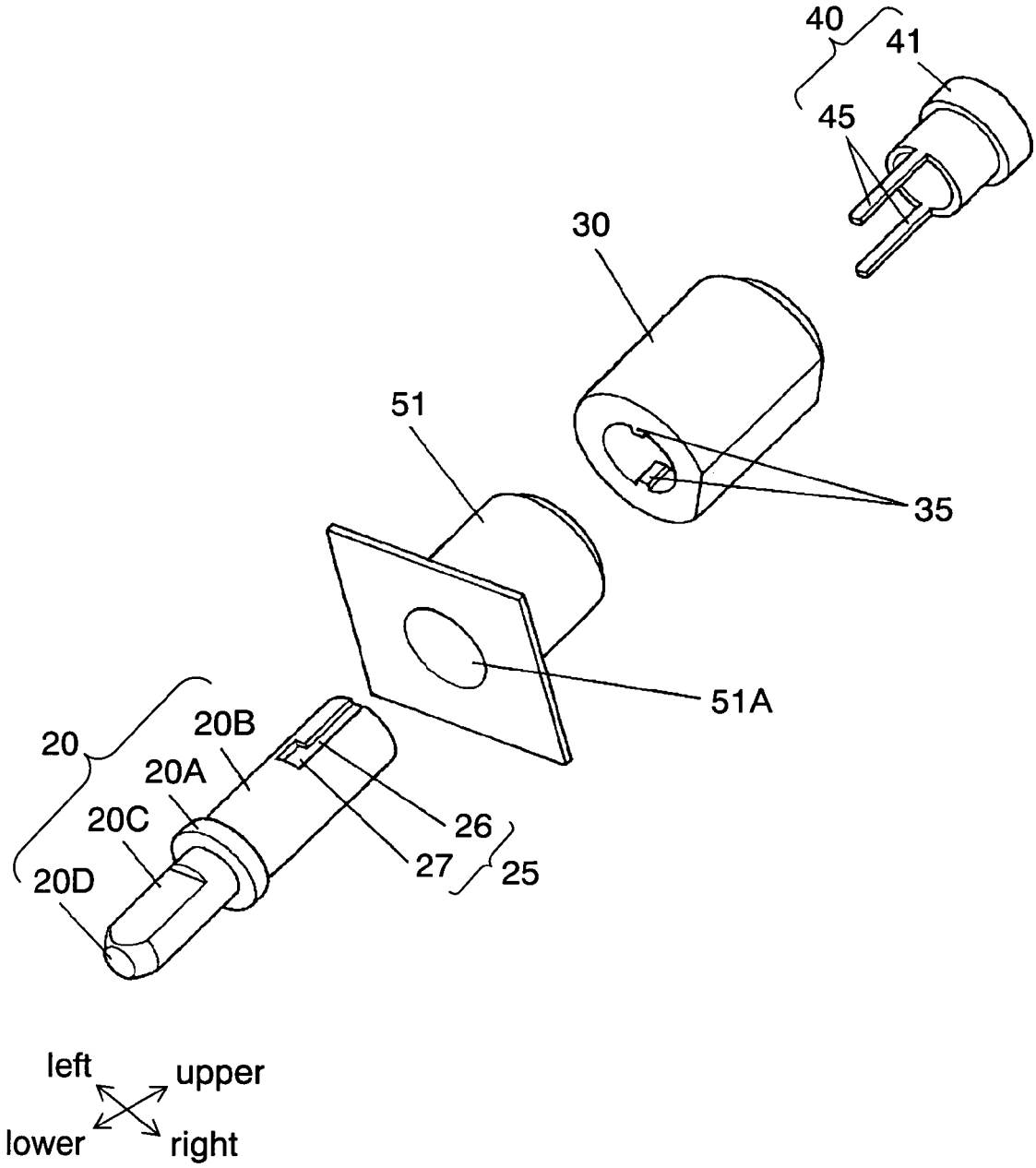
FIG. 2 is an exploded perspective view of a shaft and a periphery thereof as an essential part of the rotary encoder shown in FIG. 1.

FIG. 1 is a sectional view of a rotary encoder in accordance with a first exemplary embodiment of the present invention. FIG. 2 is an exploded perspective view of a shaft and a periphery thereof as an essential part of the rotary encoder shown in FIG. 1.

The rotary encoder has case 52 accommodating a functional element section formed of encoder 55 and switch 57, rotary shaft 20 held by bearing 51, length-adjusting shaft 30, and fixing member 40. Rotary shaft 20 is formed into a rod shape including a columnar and a cylindrical shape. Ring-shaped projection 20A is disposed in the middle of rotary shaft 20. Column section 20B is disposed on an upper portion with respect to ring-shaped projection 20A. Die-cast bearing 51 is fixed on an upper portion of resin case 52. Rotary shaft 20 is inserted in central hole 51A from the lower side of bearing 51. Rotary shaft 20 is supported by bearing 51 rotatably and so as to be movable in a direction axially of rotary shaft 20 while rotary shaft 20 fits in bearing 51.

Encoder 55 and push-switch section 57 are provided in case 52. In the lower portion of rotary shaft 20, non-circular (in cross-section) area 20C is disposed so as to meet with rotator 56 of encoder 55. Rotation of rotary shaft 20 is carried to encoder 55, whereas the axial movement is not carried to the encoder.

Tip 20D of rotary shaft 20 is in contact with movable contact 58 with springiness in push-switch section 57. In this configuration, movable contact 58 upwardly urges rotary shaft 20. The upper side of ring-shaped projection 20A is in contact with the periphery of central hole 51A of bearing 51, preventing rotary shaft 20 from coming off upwardly. Spring 59 is fixed under bearing 51 in a manner that a downwardly extending elastic arm of spring 59 is in contact with an unevenness section that is radially formed on the upper surface of rotator 56.

In an area that protrudes upwardly from bearing 51 on the periphery of rotary shaft 20, engagement groove 25 is provided into an L shape as seen from the side. Engagement groove 25 has upper groove 26 and enlarged portion 27. Upper groove 26 extends with a constant width along the axial direction of the shaft from the upper end of rotary shaft 20 that fits with length-adjusting shaft 30. The lower end of upper groove 26 broadens its width to a rectangular shape to form enlarged portion 27. In other words, enlarged portion 27 has an area extending from upper groove 26 toward a direction other than the direction axially of rotary shaft 20. In the description below, as shown in FIGS. 1 and 2, engagement groove 25 has enlarged portion 27 extending in a circumferentially "left" direction as an example, where the "left" direction represents the direction in which enlarged portion extends its width, and accordingly, the opposite direction is the "right" direction, for the sake of convenience.

Engagement groove 25 is provided with a uniform depth with respect to the central axis of rotary shaft 20. That is, the bottom surface of groove 25 is parallel to the peripheral surface of rotary shaft 20. The lower inside-wall surface of enlarged portion 27 has a flat surface perpendicular to the axial direction of the shaft. On the other hand, the upper inside-wall surface of enlarged portion 27 adjacent to upper groove 26 is formed into a leveled surface, like the lower inside-wall surface, or formed into a sloped surface so that the distance between the upper and lower surfaces increases toward the "left", i.e., toward the direction away from upper groove 26. The "right" inside-wall surfaces of enlarged portion 27 and upper groove 26 are flat with no stepped section. Although rotary shaft 20 has two grooves 25 that are symmetrically arranged about the central axis of rotary shaft 20, it is not limited thereto; rotary shaft 20 may contain groove 25 at a single position, or at three or more positions as long as they are located at an identical angle around the central axis of rotary shaft 20.

Length-adjusting shaft 30 is connected with the upper portion of rotary shaft 20. That is, length-adjusting shaft 30 has an engagement with the upper portion of shaft 20 that protrudes from bearing 51. Length-adjusting shaft 30 has a cylindrical shape. The inside wall of the cylinder has two rectangular projections 35 that protrude inwardly. When shaft 30 is attached to shaft 20, each of projections 35 corresponding to each of grooves 25 settles in respective enlarged portion 27. Each projection 35 has a top surface that conforms to the bottom surface of groove 25.

Projections 35 are preferably kept in press-fit condition between the upper inside-wall surface and the lower inside-wall surface of enlarged portion 27 as will hereinafter be described in detail. In addition, rotary shaft 20 and length-adjusting shaft 30 are preferably made of the same material; in particular, employing die-casting is preferable because it increases hardness of the shafts and decreases dimensional variations under high temperature and humid conditions, which allows projections 35 to keep preferable press-fit conditions in enlarged portion 27.

Fixing member 40 has solid cylindrical cap 41 on the upper portion and a pair of linear sections 45 downwardly extending along a direction parallel to a rotational axis of rotary shaft 20. Each of linear sections 45 is inserted and mounted in respective groove 25 from above length-adjusting shaft 30, that is, from the side opposite to rotary shaft 20. Each of linear sections 45 has uniform width and is inserted in each groove 25 so as to settle in enlarged portion 27. To be more specific, linear sections 45 are disposed in press-fit condition in a way that, at least at the lower portion of linear sections 45, the left side thereof has an intimate contact with the right side of each projection 35, and the right side thereof has an intimate contact with the right inside-wall of enlarged portion 27. Each of linear sections 45 in press-fit condition blocks projection 35 in enlarged portion 27. Linear sections 45 stay between rotary shaft 20 and length-adjusting shaft 30, thereby securely holding the two shafts.

A bonding method in which linear sections 45 are bonded to the shafts by adhesive can be an alternative; however, press-fitting is easy and simple, compared to the adhesive bonding.

When rotary shaft 20 and length-adjusting shaft 30 are made by die-casting, fixing member 40 is preferably made of die-cast material. That is, fixing member 40 is preferably formed of a material the same as the material that forms rotary shaft 20 and length-adjusting shaft 30. Fixing member 40 has at least linear section 45. Linear section 45 may be a U-bend of a steel wire having a circular or square cross-section, or linear sections 45 may have different cross-section shapes that fit in grooves 25, respectively.

Since length-adjusting shaft 30 has a cylindrical shape, it is preferable that fixing member 40 has cap 41. When fixing member 40 is attached to length-adjusting shaft 30, the periphery of the lower surface of cap 41 meets with inner middle stepped section 30A, thereby blocking a downward movement of fixing member 40. In addition, cap 41 covers the top of length-adjusting shaft 30 so as to serve as a dust cover of length-adjusting shaft 30.

The rotary encoder with a push switch as a rotary electronic component of the present invention is thus structured. In a practical situation, the rotary encoder constitutes an input operation section of various types of equipment after knob 53 is attached to length-adjusting shaft 30. According to the structure of the embodiment, rotary shaft 20 and length-adjusting shaft 30 are engaged with each other at a simply structured projection and groove sections. That is, axially extending linear sections 45 of fixing member 40 can reliably prevent rotary shaft 20 and length-adjusting shaft 30 from coming-off.

Next will be described operation of the rotary encoder. When a user operates knob 53 to rotate rotary shaft 20 connected with length-adjusting shaft 30 integrally, rotator 56 is rotated. The rotation allows encoder 55 to output a pulse signal. The signal is obtained via terminals 52A and 52B. When the user pushes knob 53 to push down rotary shaft 20 incorporated with length-adjusting shaft 30, an electrical connection is established between terminals 58A in switch 57. Rotary shaft 20 is thus responsible for actuating a functional element section.

Length-adjusting shaft 30 is integrated with rotary shaft 20. In the manufacturing process, a "standardized" major part can be prepared prior to an attaching process of length-adjusting shaft 30. The "standardized" major part has universal applicability to a variety of equipment. When length-adjusting shaft 30 is attached to rotary shaft 20, length-adjusting shaft 30 selected from shafts of different lengths and fixing member 40 that fits with the selected shaft are used according to a shaft length suitable for the equipment on which the encoder is mounted. Employing the procedures above quickly produces a rotary encoder with a proper shaft length.

Figure 3A:
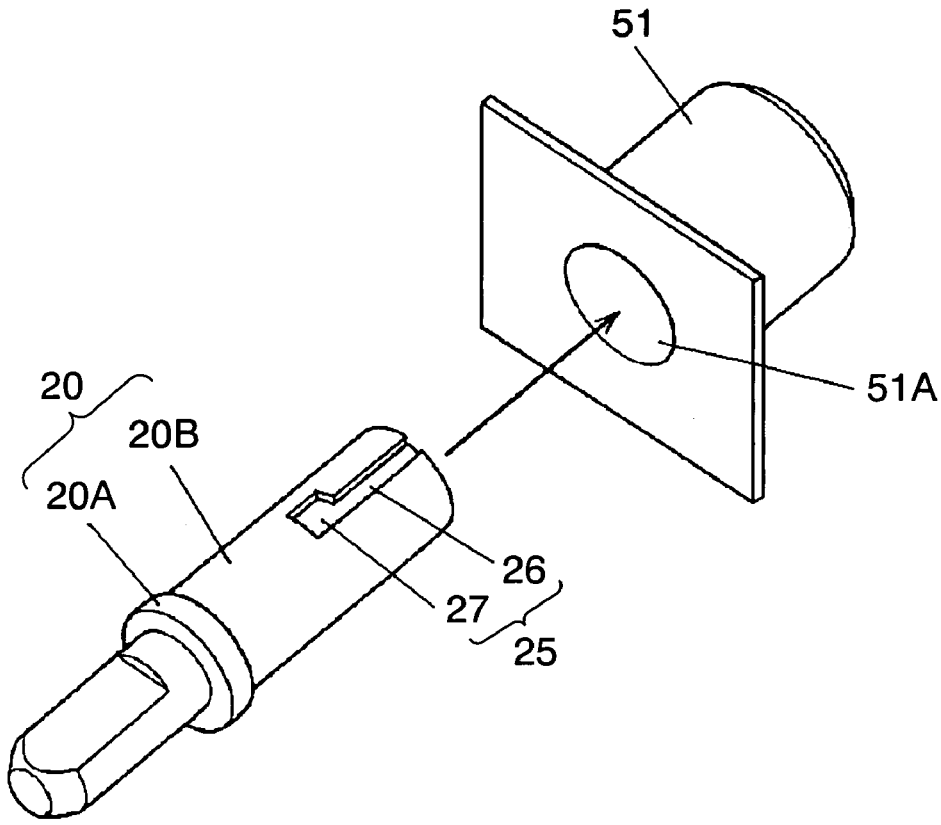
FIGS. 3A through 4 are exploded perspective views illustrating the manufacturing process of the rotary encoder shown in FIG. 1.
Figure 3B:
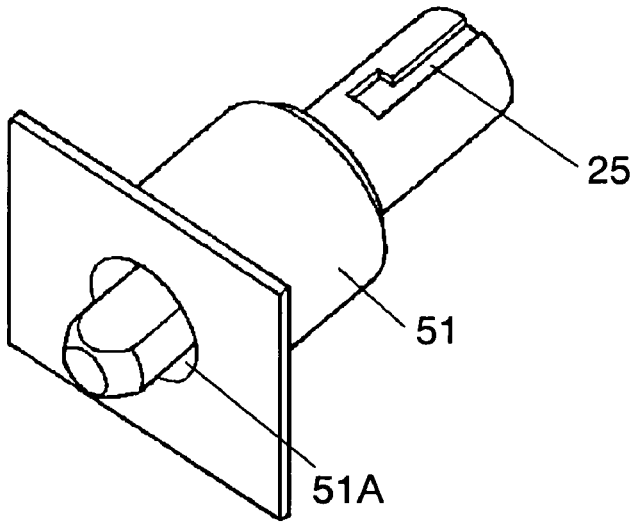
Figure 4:
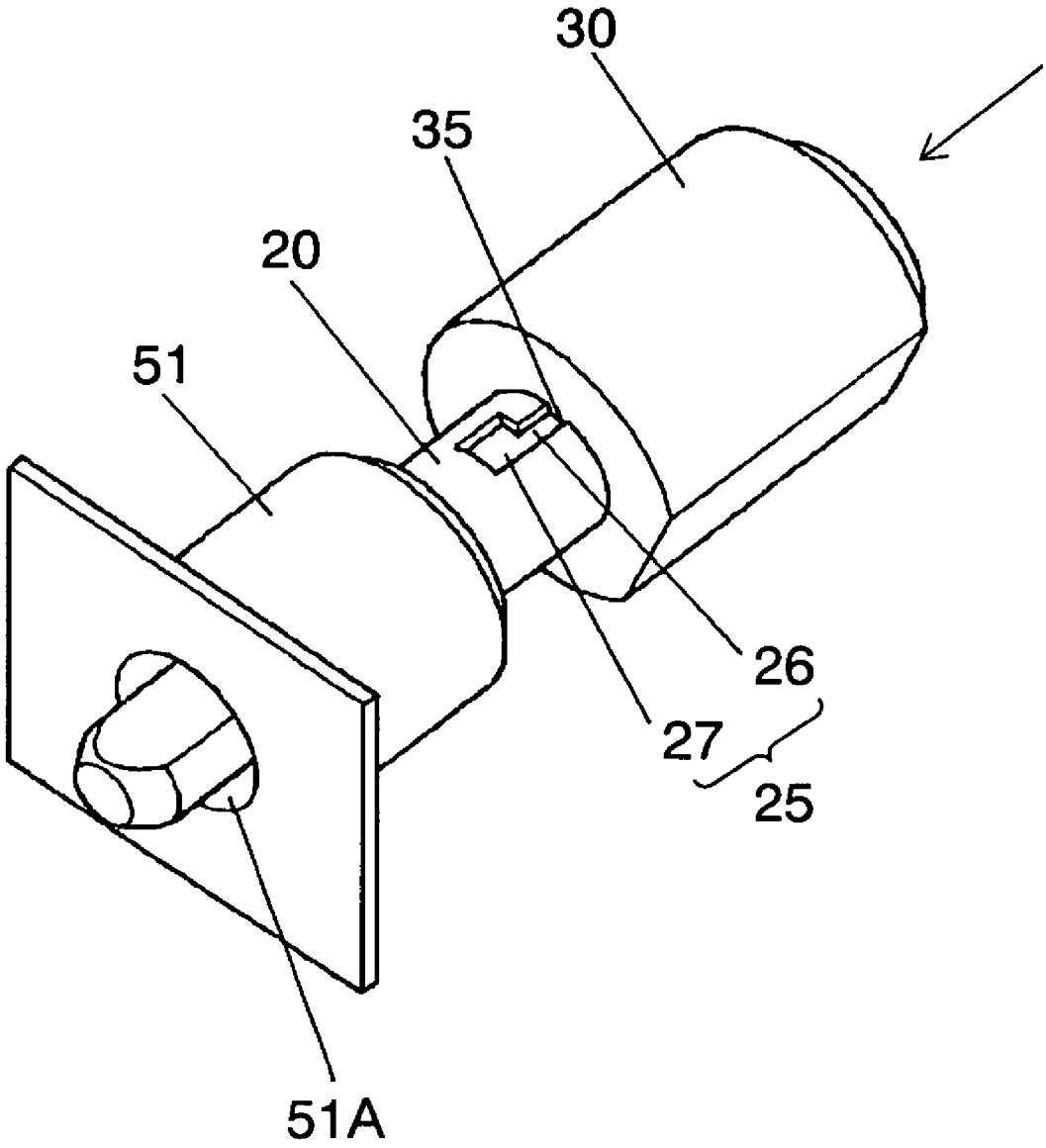
Figure 5:
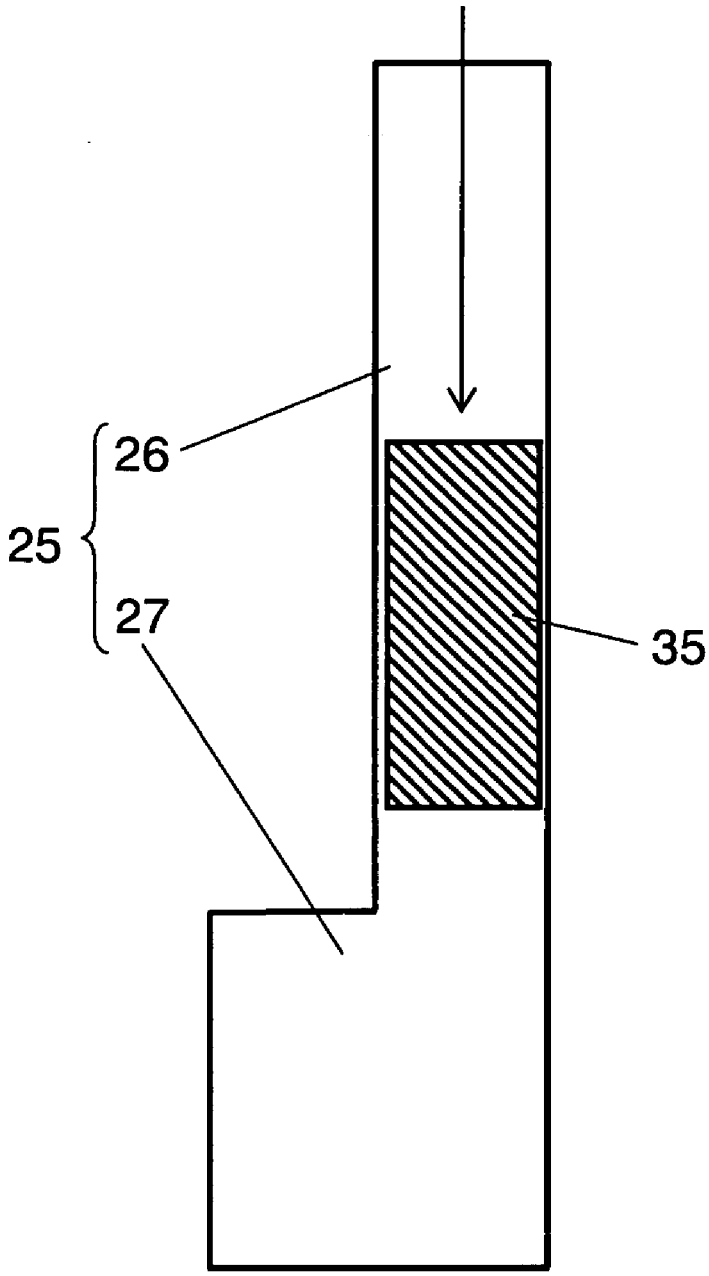
FIGS. 5 through 7 illustrate the manufacturing process, with the essential part enlarged, of the rotary encoder shown in FIG. 1.
Figure 6:
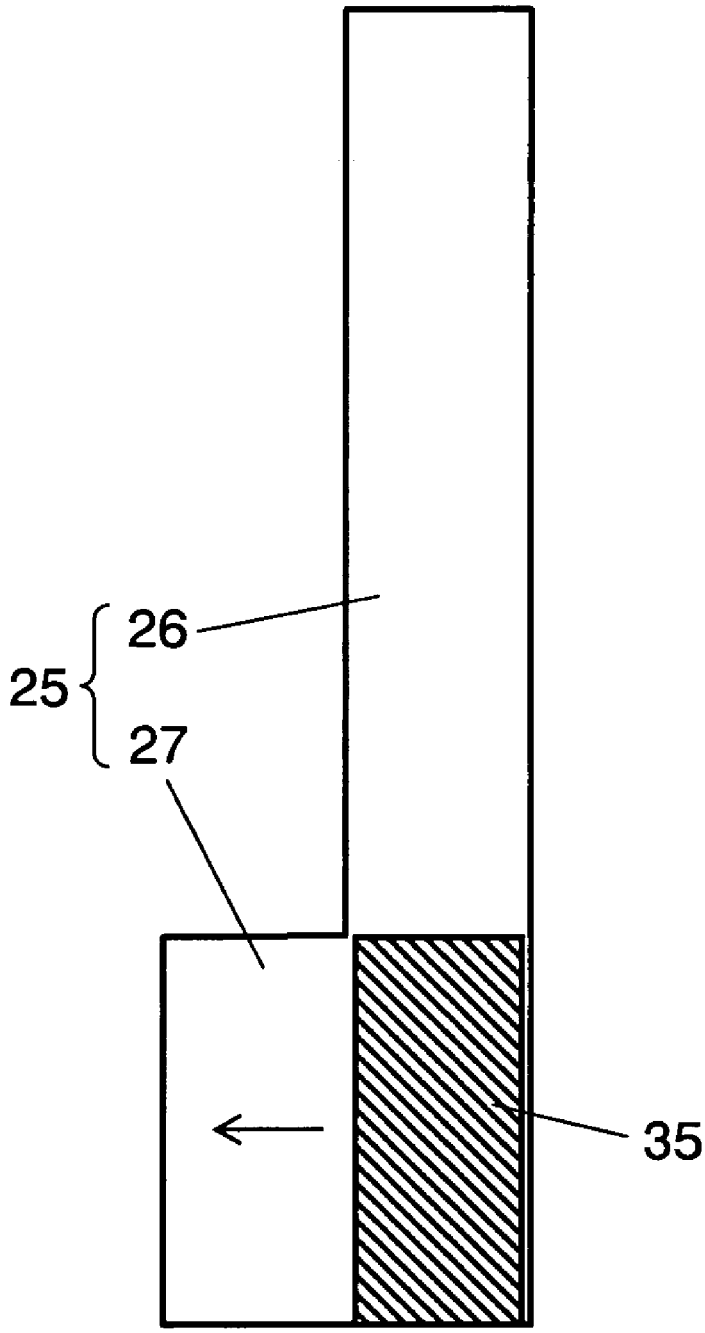
Figure 7:
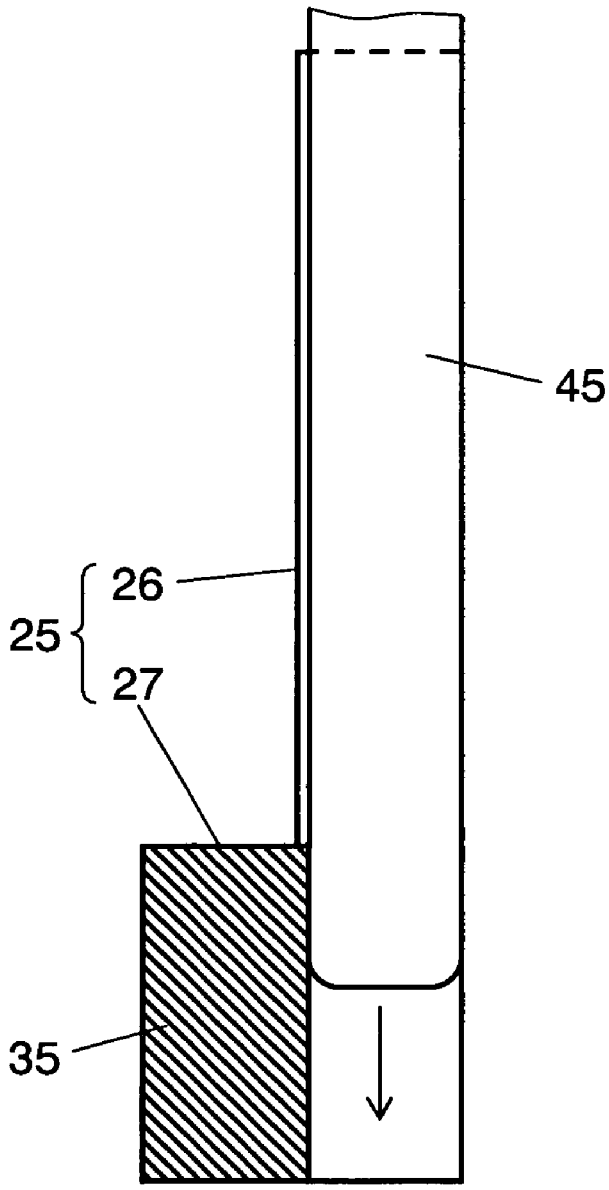
Figure 8:
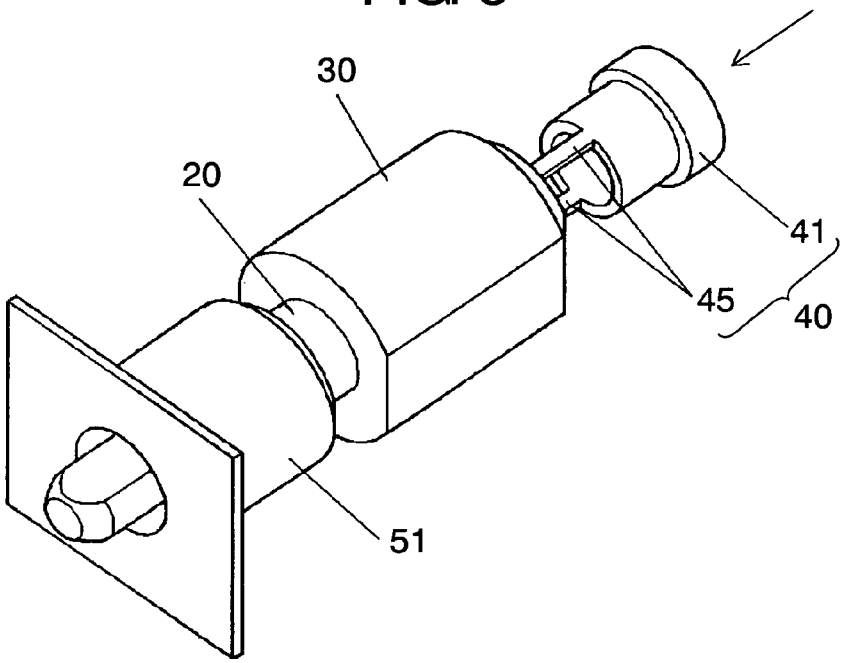
FIG. 8 is an exploded perspective view illustrating the manufacturing process of the rotary encoder shown in FIG. 1.

Here will be described how to attach length-adjusting shaft 30 to rotary shaft 20 with reference to FIG. 3A through FIG. 8. For the sake of clarity, case 52 and the like are not shown in the drawings. FIGS. 3A through 4, and FIG. 8 are exploded perspective views illustrating the assembling process of length-adjusting shaft 30, fixing member 40, rotary shaft 20, and bearing 51. FIGS. 5 through 7 show enlarged views illustrating the movement of projection 35 in engagement groove 25 in a side view.

First, rotary shaft 20 for actuating a functional element section is prepared. Rotary shaft 20 has engagement groove 25 in the periphery of the upper portion. Rotary shaft 20 is inserted into central hole 51A as shown in FIG. 3A. At that time, rotary shaft 20 is inserted from the lower side of bearing 51 in a manner that the upper portion having engagement groove 25 protrudes upward as shown in FIG. 3B. After that, bearing 51 is combined with case 52 that accommodates the functional element section, i.e., encoder 55 and switch 57, so that the functional element section can be operated by rotary shaft 20. The major part of the rotary encoder is thus completed.

On the other hand, length-adjusting shaft 30 is prepared. Length-adjusting shaft 30 has projection 35 on the inner periphery of the cylinder section. The width of projection 35 is smaller than that of upper groove 26 of engagement groove 25. Length-adjusting shaft 30 is attached to rotary shaft 20 at the upper portion. As shown in FIG. 4, length-adjusting shaft 30 is inserted into rotary shaft 20 in the axial direction of rotary shaft 20 shown by the arrow while projection 35 follows upper groove 26 of engagement groove 25. FIG. 5 shows projection 25 inserted in engagement groove 25 seen from the side. Rotary shaft 20 and length-adjusting shaft 30 are thus moved relatively in an axial direction of rotary shaft 20 to insert projection 35 into upper groove 26

Projection 35 moves along upper groove 26 until the lower end reaches the bottom wall of enlarged portion 27, as shown in FIG. 6. Length-adjusting shaft 30 here is the one having a proper length selected from the shafts with different lengths. In this state, the lower end of projection 35 meets with the bottom wall of enlarged portion 27, and the upper end of projection 35 is slightly higher than the top wall of enlarged portion 27.

Following the step above, projection 35 is moved into the area enlarged to the left of enlarged portion 27 in the direction shown by the arrow in FIG. 6 by rotating length-adjusting shaft 30 or rotary shaft 20. The rotation allows projection 35 to move along the bottom wall of enlarged portion 27 and to press-fit between the top wall and the bottom wall of portion 27. That is, rotating shaft 30 and shaft 20 are rotated relatively to move projection 35 into enlarged portion 27.

The rotation of the shafts is continued until the left end of projection 35 meets the left-side wall of enlarged portion 27. In this terminated state, the right end of projection 35 protrudes slightly from the left side of upper groove 26.

Figure 9:
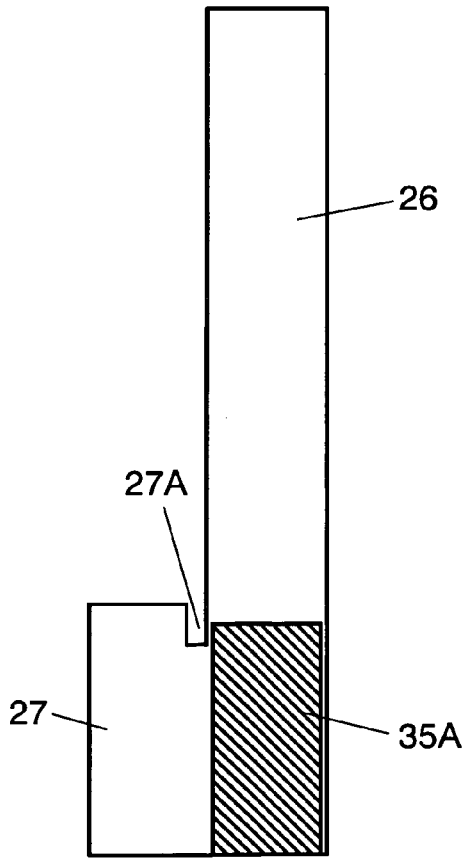
FIG. 9 shows an enlarged essential part of another rotary encoder in accordance with the first exemplary embodiment.
Figure 10A:
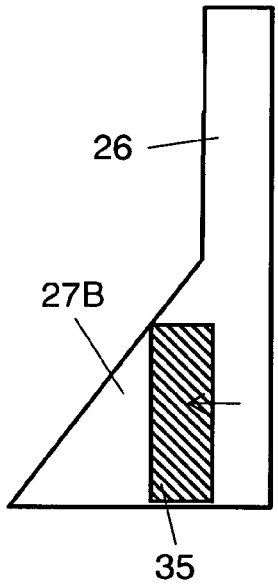
FIG. 10A shows an enlarged essential part of still another rotary encoder in accordance with the first exemplary embodiment.
Figure 10B:
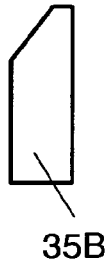
FIG. 10B is a plan view of a projection that fits with a groove of the rotary encoder shown in FIG. 10A.

Although length-adjusting shaft 30 is attached to rotary shaft 20 by press-fitting of projection 35 in engagement groove 25, each of which has the aforementioned shape, the shapes and dimensions thereof are not limited thereto. For example, as shown in FIG. 9, enlarged portion 27 may be provided with press-fitting protrusion 27A on its upper portion. In this case, projection 35A sized shorter than the height of enlarged portion 27 is forced into enlarged portion 27 with a crushing of press-fitting protrusion 27A. Enlarged portion 27 may be triangular as shown in FIG. 10A. In this case, projection 35 is press-inserted in enlarged portion 27, with the facing corner of projection 35 crushed. FIG. 10B shows another applicable structure. Projection 35B has an angled section that conforms to the inside slope wall of enlarged portion 27.

Next, fixing member 40 is prepared. Fixing member 40 has a pair of linear sections 45 that extends downward so as to fit with upper grooves 26. At last, each of linear sections 45 is inserted into respective upper groove 26 in the direction shown by the arrows in FIGS. 7 and 8.

Linear section 45 is prepared to have at least a dimension so that linear section 45 at the portion corresponding to projection 35 is press-inserted between the right end of projection 35 and the right side-wall of enlarged portion 27 to be in intimate contact with them at both side faces thereof. In this configuration, once linear sections 45 are inserted into upper grooves 26, projections 35 can no longer rotate in a direction of coming-off. Projection 35 thus has press-fit engagement with the end faces of enlarged portion 27, allowing length-adjusting shaft 30 to have a secure connection to rotary shaft 20 without play. The downward movement of cap 41 is blocked by face-to-face contact with inner middle stepped section 30A, as shown in FIG. 1.

With this manner of assembly, length-adjusting shaft 30 can be easily attached to rotary shaft 20 by rectilinear and rotational movement with respect to the axial direction of the shaft. This allows the manufacturing process to have a minimized number of steps, encouraging a smooth transition to robotic handling. When rotary shaft 20 is inserted through central hole 51A from the lower direction of bearing 51, ring-shaped projection 20A disposed on shaft 20 meets with the outer periphery of central hole 51 to protect the shaft from coming off. The structure eliminates the process where a fixing member, such as a C-shaped fixing ring, is attached to the shaft against coming-off. That is, the steps for manufacturing the main part can be reduced. Rotary shaft 20 can be formed by a pair of molds that can be divided at the side. Employing such simple molds decreases the time and cost for making the molds, thereby reducing the production cost of rotary shaft 20. Similarly, fixing member 40 can be formed by a pair of molds that can be divided into an upper-half and a lower half with low cost. Since the shaft length of the rotary encoder as a finished product is adjusted by length-adjusting shaft 30, the main part of the encoder can be produced on a large-volume basis as a half-finished product having rotary shaft 20 of a standardized length. This minimizes losses caused by inconsistency of the assembly facilities, thereby increasing productivity and decreasing production cost.

As for the structure of length-adjusting shaft 30, the upper portion of the shaft can be designed to have a large diameter so as to minimize play between knob 53 and length-adjusting shaft 30. Length-adjusting shaft 30 itself may serve as a knob. In this case, knob 53 can be eliminated.

Figure 11:
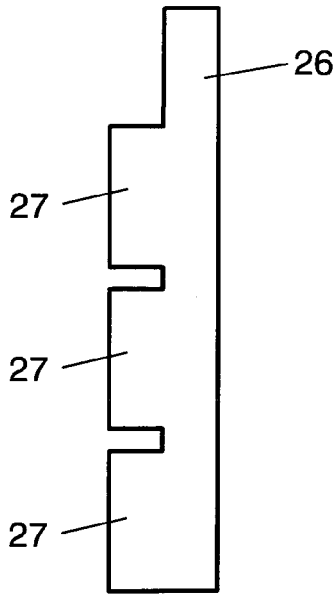
FIG. 11 shows an enlarged essential part of yet another rotary encoder in accordance with the first exemplary embodiment.

Although some examples for the attachment of length-adjusting shaft 30 to rotary shaft 20 are introduced in the embodiment, the invention is not limited thereto. For example, enlarged portion 27 can be formed in a midpoint of groove 25 if the insertion length in the direction axially of rotary shaft 20 of length-adjusting shaft 30 is adjusted. In this case, enlarged portion 27 may be formed at two or more positions, as shown in FIG. 11, along upper groove 26. Length-adjusting shaft 30 can take different positions with respect to rotary shaft 20 by selecting an enlarged portion in which projection 35 is inserted. That is, knob 53 can be positioned at different levels of height with a single length-adjusting shaft. In the structure above, the enlarged portions are more preferably arranged alternately on the left side and on the right side of groove 25 so that projection 35 can be easily guided to a desirable enlarged portion.

Additionally, it is possible to engage length-adjusting shaft 30 with rotary shaft 50 which is provided with engagement groove 25A at the upper end. Engagement groove 25A is simply formed of the enlarged portion. Hereinafter will be described the engaging procedures briefly.

Length-adjusting shaft 30 suitable for rotary shaft 50 is prepared. Length-adjusting shaft 30 is moved in an axial direction of the shaft so as to insert projection 35 into groove 25A. Following this, projection 35 is moved in groove 25A, with rotating movement of shaft 30 or shaft 50, until one side of projection 35 makes contact with the inside wall of groove 25A. After that, fixing member 40 suitable for groove 25A is attached to the connected two shafts from the upper direction of length-adjusting shaft 30, i.e., from the direction opposite to rotary shaft 50 so that linear section 45 is inserted with a press-fit into the gap formed by the other side of projection 35 and the other inner wall of groove 25A. The insertion of linear section 45 urges projection 35 to have an intimate contact with the inside wall of groove 25A. That is, fixing member 40 holds rotary shaft 50 and length-adjusting shaft 30 by inserting linear sections 45 between the two shafts. Groove 25A of rotary shaft 50, in spite of such a simple shape, offers a similar effect.

Figure 12:
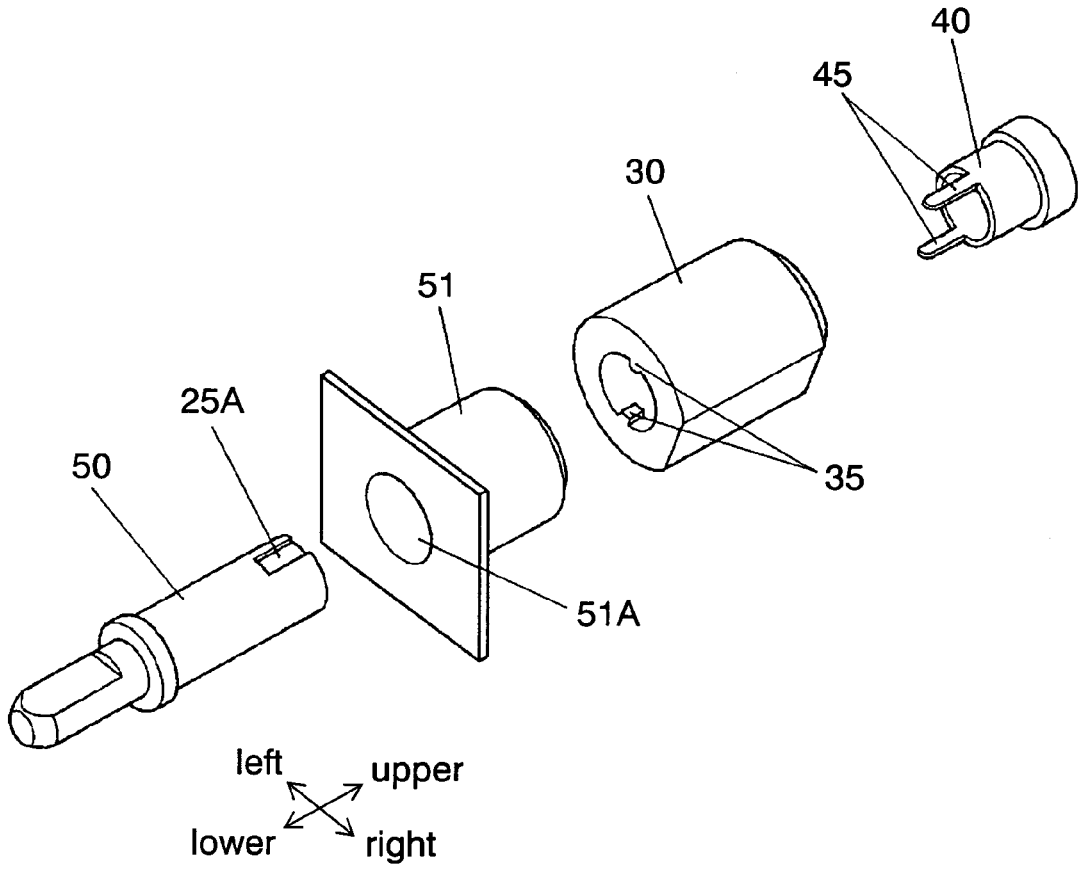
FIG. 12 shows an enlarged essential part of yet another rotary encoder in accordance with the first exemplary embodiment.

In the structure shown in FIG. 12, fixing member 40 may contain linear sections 45 with stepped portions. When such fixing member 40 is attached to the shaft, each stepped portion meets with the upper side of projection 35, by which the upward movement of projection 35 is prevented.

According to the rotary encoder of the present invention, as described above, the engagement of rotary shaft 20 (50) and length-adjusting shaft 30 is obtained by simply formed projections and grooves. Besides, fixing member 40 having linear sections 45 extending parallel to the direction axially of the shaft firmly prevents rotary shaft 20 (50) and length-adjusting shaft 30 from coming apart. The firmly engaged structure can be obtained by simple manufacturing steps. Furthermore, the shaft length is adjustable to a length that equipment demands. Such a flexible structure is applicable to small-lot production of a variety of products.

Second Exemplary Embodiment

Figure 13:
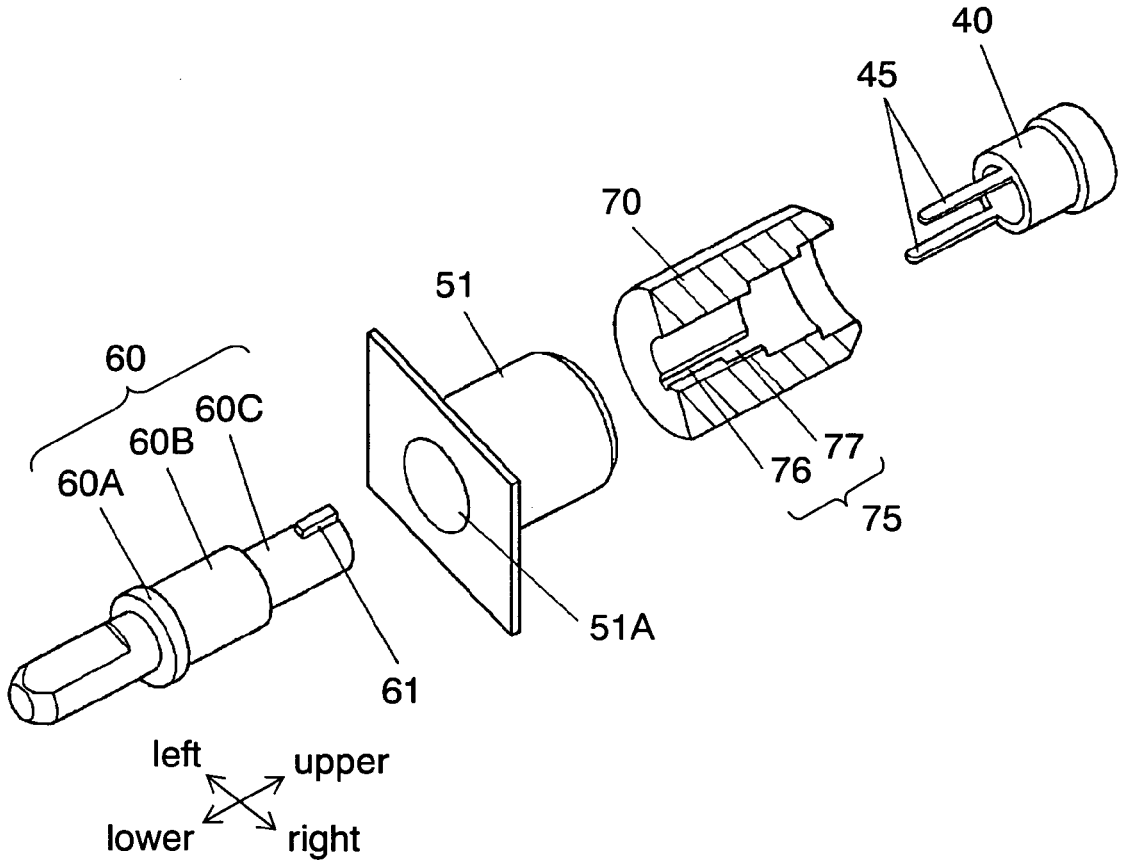
FIG. 13 is an exploded perspective view of a shaft and a periphery thereof as an essential part of a rotary encoder in accordance with a second exemplary embodiment of the present invention.

FIG. 13 is an exploded perspective view of a shaft and a periphery thereof as an essential part of the rotary encoder in accordance with a second exemplary embodiment. The structure of this embodiment differs from that of the first embodiment in that the engaging sections disposed on the rotary shaft and the length-adjusting shaft are replaced with each other. The description will be given hereinafter, focusing on the shafts as the essential part. Like parts are identified by the same reference marks as in the structure described in the first embodiment, and descriptions thereof will be omitted. Length-adjusting shaft 70 is shown in a cutaway view in FIG. 13.

Rotary shaft 60 for actuating a functional element section is inserted through central hole 51A of bearing 51 disposed on case 52 shown in FIG. 1. Rotary shaft 60 is supported by bearing 51 so as to be rotatable and undergo a push down operation. Rotary shaft 60 has ring-shaped projection 60A in a mid section. Ring-shaped projection 60A has a diameter larger than central hole 51A of bearing 51. Rotary shaft 60 has ring-shaped projection 60A, first column section 60B rotatably held in central hole 51A of bearing 51, and second column section 60C with a diameter smaller than that of first column section 60B. First column section 60B is disposed above ring-shaped projection 60A, and second column section 60C is disposed above first column section 60B.

First column section 60B has a length (in the direction parallel to the rotation axis) sufficient to keep section 60B from coming out of central hole 51A when the shaft is pushed down. Ring-shaped projection 60A is structured similar to ring-shaped projection 20A in the first embodiment. In this structure, however, there is no specific limitation on the means for preventing rotary shaft 60 from upwardly coming off. Second column section 60C has rectangular projections 61 on the cylindrical periphery of the upper portion. Projections 61 are formed at two positions on the periphery in symmetrical arrangement about the rotation axis of rotary shaft 60; however, the number of the projections has no limitation, as is in the case of projection 35 in the first embodiment. A diameter including the height of projection 61 is within a diameter of first column section 60B.

At least the lower portion of length-adjusting shaft 70, to which rotary shaft 60 has an engagement, is formed into a cylindrical shape. Length-adjusting shaft 70 is provided with engagement grooves 75 extending in a direction axially of the shaft and formed in the inside wall of the cylindrical structure so that each groove 75 corresponds to respective projection 61. Similar to engagement groove 25 in the first embodiment, engagement groove 75 has an L-shape. Groove 75 has lower groove 76 and enlarged portion 77. Having a width larger than projection 61, lower groove 76 linearly extends in the axial direction of rotary shaft 60. Enlarged portion 77 extends its width from the upper end of groove 76 toward the peripheral direction. Due to the similarity with groove 25 in the first embodiment, detailed explanation of the L-shaped structure will be omitted. Hereinafter, for the sake of convenience, the direction in which enlarged portion 77 of groove 75 shown in FIG. 13 extends is defined as the "right" direction, and accordingly, the opposite direction is the "left" direction. Like in the first embodiment, fixing member 40 has linear sections 45 that fit with grooves 75.

Next will be described on the assembling procedure of rotary shaft 60 and length-adjusting shaft 70 with reference to FIGS. 14 through 17. FIGS. 14 through 17 are partly cutaway perspective views for describing the assembling procedure.

Figure 14:
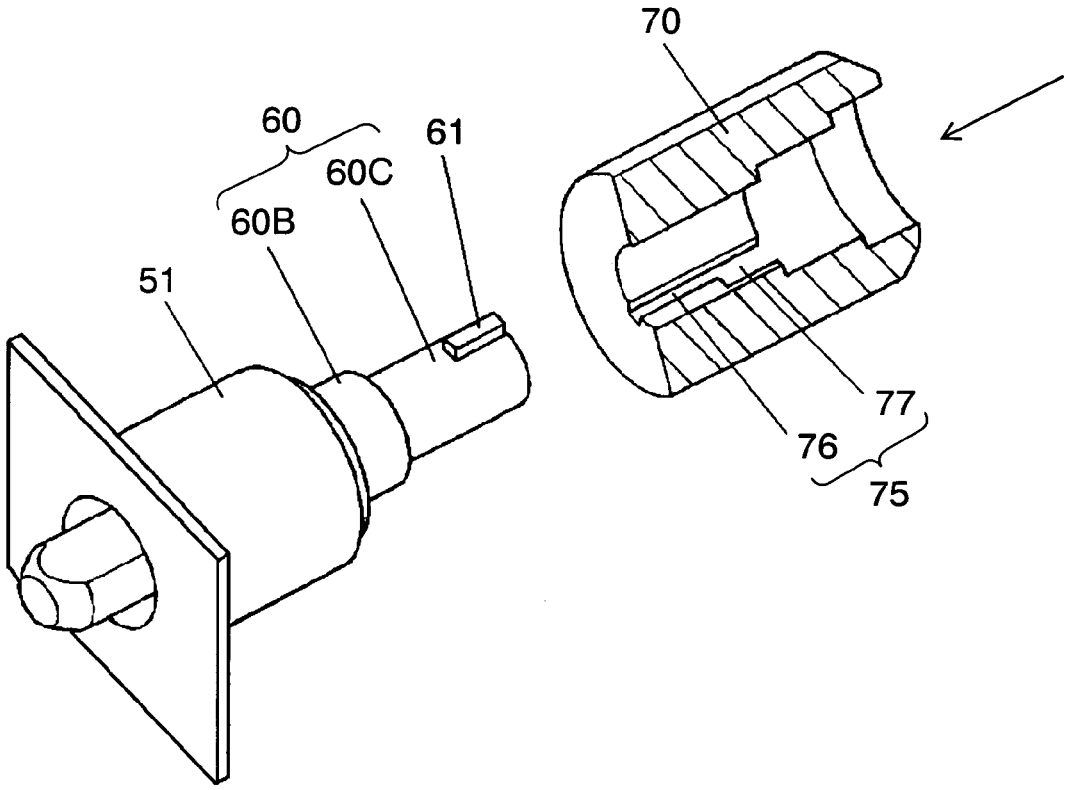
FIGS. 14 through 17 are exploded perspective views with partial cutaways, which illustrate the manufacturing process of the rotary encoder shown in FIG. 13.
Figure 15:
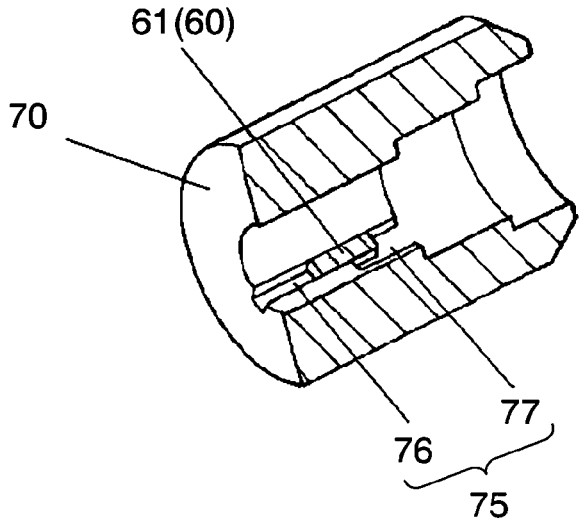

First, as shown in FIG. 14, rotary shaft 60, which actuates the functional element section (not shown) is inserted into bearing 51 from below. Next, length-adjusting shaft 70 is inserted into the upper portion of rotary shaft 60 extending from bearing 51 along an axial direction of the shaft as shown by the arrow in FIG. 14. At that time, each projection 61 is inserted into respective lower groove 76 as shown in FIG. 15. That is, rotary shaft 60 and length-adjusting shaft 70 is relatively moved in an axial direction of shaft 60 so as to insert projection 61 into lower groove 76. Rotary shaft 60 or length-adjusting shaft 70 is then rotated when projection 61 reaches a position of enlarged portion 77 so as to locate projection 61 in the enlarged area at the right side of enlarged portion 77. That is, rotary shaft 60 and length-adjusting shaft 70 are rotated relatively to move projection 61 into enlarged portion 77. For sake of clarity, FIG. 15 and FIG. 16 only show projection 61 in rotary shaft 60.

Projection 61 is inserted into enlarged portion 77 until the right end of projection 61 meets with the right-side wall of the rightward extending area of enlarged portion 77. When the right end of projection 61 fits with the right-side wall of enlarged portion 77, the left end of projection 61 slightly protrudes from the right side of lower groove 76. That is, projection 61 has a width slightly larger than that of enlarged portion 77.

Figure 16:
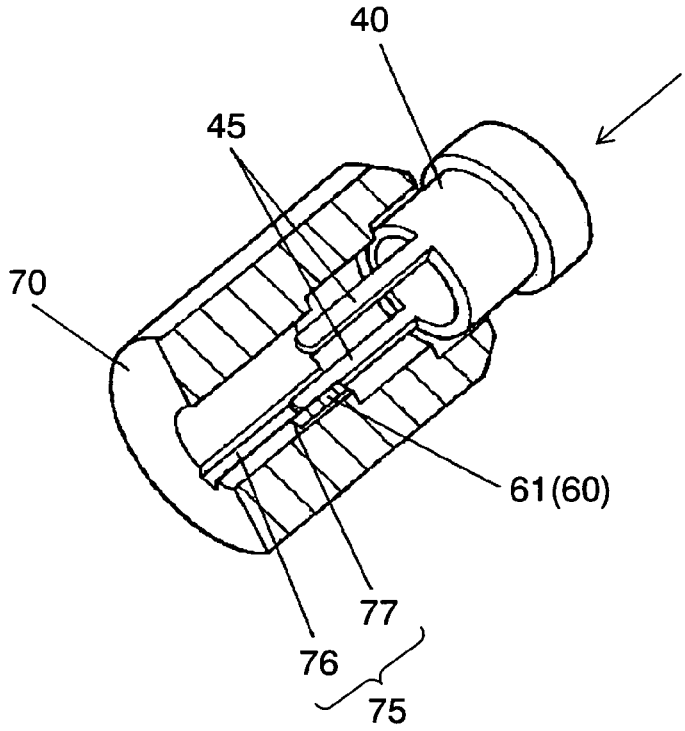
Figure 17:
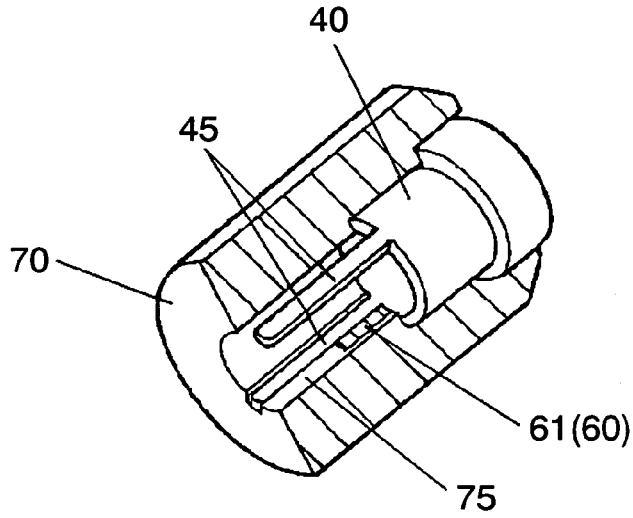
Figure 18:
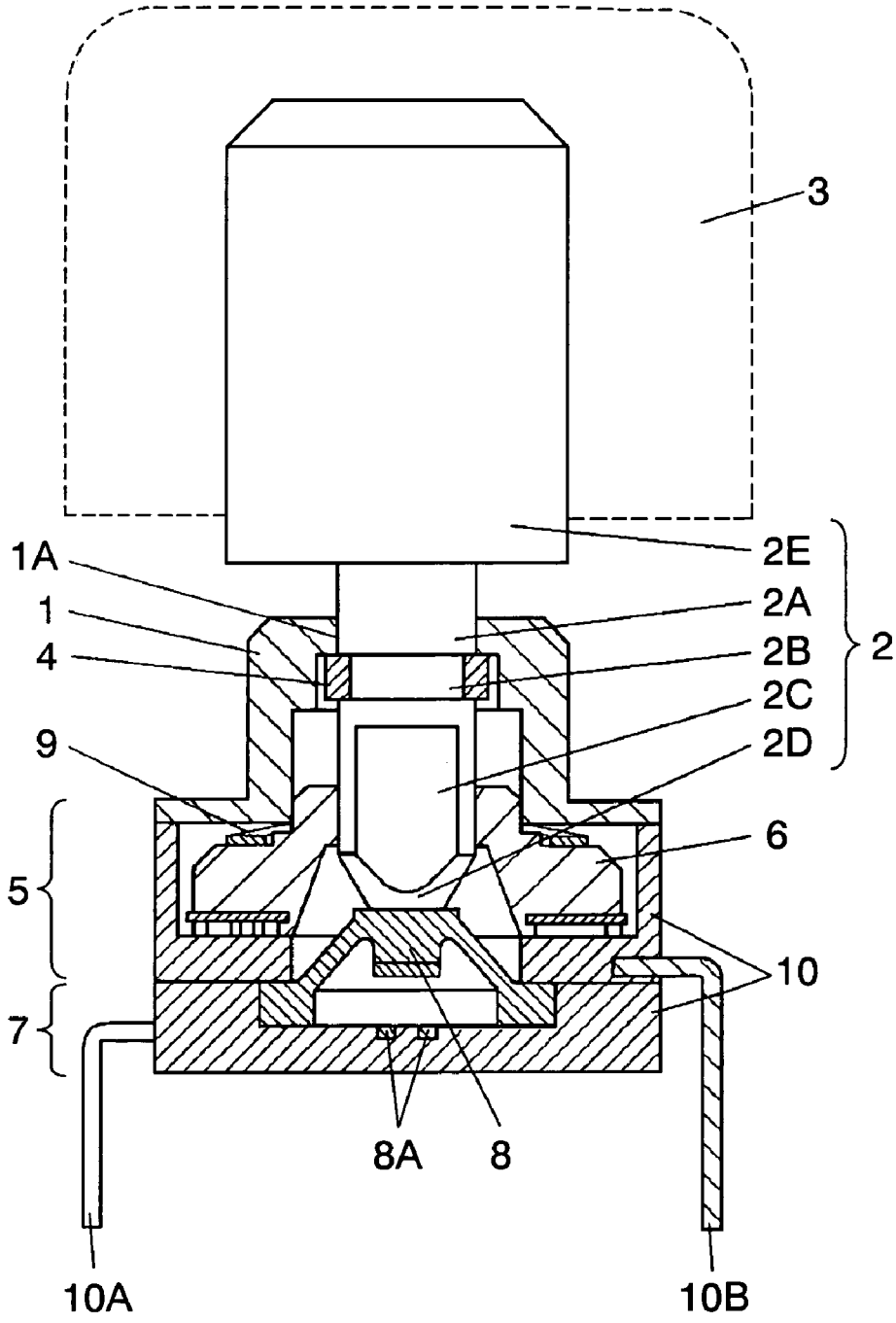
FIG. 18 PRIOR ART
FIG. 18 is a sectional view of a conventional rotary encoder.
Figure 19:
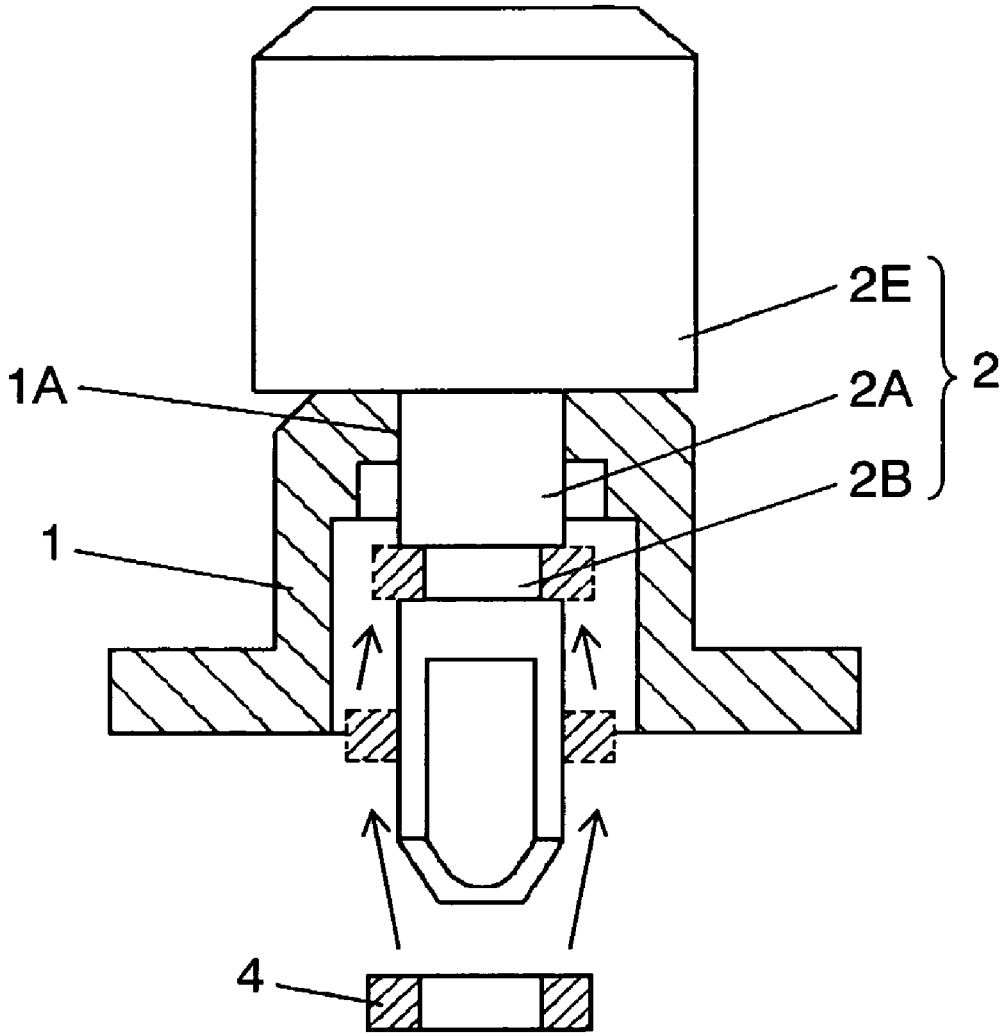
FIG. 19 PRIOR ART
FIG. 19 shows an essential part of the rotary encoder shown in FIG. 18 where a bearing and an operation shaft are being assembled.

Following this, each of linear sections 45 of fixing member 40 is inserted into respective groove 75 from the upper side of length-adjusting shaft 70, i.e., from the side opposite to rotary shaft 60 as shown in FIG. 16. Linear sections 45 are press-inserted between the left end of projection 61 and the left side-wall of enlarged portion 77. Once linear sections 45 are inserted into lower grooves 76, projections 61 can no longer rotate. As shown in FIG. 17, projection 61 thus has press-fit engagement with the end of enlarged portion 77, allowing length-adjusting shaft 70 to have a secure connection to rotary shaft 60 without play. Like in the first embodiment, linear sections 45 inserted between rotary shaft 60 and length-adjusting shaft 70 provide an engagement between the two shafts. Also according to the structure, linear sections 45 of fixing member 40 extending parallel to the direction axially of the shaft can prevent rotary shaft 60 and length-adjusting shaft 70 from coming off each other by the engagement of rotary shaft 60 and length-adjusting shaft 70 obtained by simply formed projections and grooves.

The rotary encoder produced through the steps above has similar effect to the structure introduced in the first embodiment. With the axial and rotational movements, projection 61 is settled in the rightward expanding area of enlarged portion 77. Besides, linear sections 45 of fixing member 40 extending parallel to the direction axially of the shaft firmly holds rotary shaft 60 and length-adjusting shaft 70, thereby preventing coming-off of the two shafts. The structure above allows a rotary encoder to have a desirable shaft length easily and arbitrarily. The structure of the embodiment has an advantage the same as that of the first embodiment; the main part of the encoder can be produced on a large-volume basis as a half-finished product having rotary shaft 60 of a standardized length.

The structure of the engagement sections of shaft 70 and shaft 60 is not limited to the structure above. For example, enlarged portion 77 can be formed at a mid section or at the lower portion of engagement groove 75 and projection 61 inserted in such enlarged portion 77 can be fixed by respective linear section 45 of fixing member 40. In a case where enlarged portion 77 is formed at a mid section, the upper end or the lower end of projection 61 may be press-fitted into the upper or lower side-wall of the rightward expanding area of enlarged portion 77. Like groove 25 in the first embodiment, enlarged portion 77 and projection 61 can be formed into the shapes shown in FIGS. 9 through 11. For example, enlarged portion 77 can be formed at plural positions along lower groove 76.

Although the description above introduces a rotary encoder having a push switch as an example of a rotary electronic component, it is not limited thereto; the structure of the present invention is applicable to a rotary encoder without a push switch, and other rotary electronic components, such as a variable resistor and a rotary switch.

According to the rotary electronic component of the present invention, the main part of the structure can be produced as a standardized unit, and components with different shaft lengths can be easily manufactured. The structure obtained by simplified manufacturing steps shortens delivery time. The rotary electronic component is of great value as an input operation section of electronic equipment.

What is claimed is:

1. A rotary electronic component comprising:

a functional element section;

a case configured to accommodate the functional element section;

a rotary shaft configured to actuate the functional element section;

a bearing configured to support the rotary shaft, the bearing being fixed to the case;

a length-adjusting shaft fixed to a portion of the rotary shaft, the portion protruding from the bearing; and a fixing member with a linear section extending along a direction parallel to a rotational axis of the rotary shaft, the fixing member being configured to hold the rotary shaft and the length-adjusting shaft by inserting the linear section between the rotary shaft and the length-adjusting shaft.

2. The rotary electronic component according to claim 1, wherein the rotary shaft is provided with an engagement groove on a periphery thereof, the engagement groove containing an upper groove extending in a direction axially of the rotary shaft from an end with which the length-adjusting shaft engages, and an enlarged portion having an area extending from the upper groove toward a direction other than the direction axially of the rotary shaft;

the length-adjusting shaft has a cylindrical shape, and a projection is disposed on an inside periphery of the length-adjusting shaft so as to meet with the enlarged portion; and the linear section is inserted in the engagement groove from a side opposite to the rotary shaft to prevent the projection from moving toward a direction other than the direction axially of the rotary shaft so that the fixing member has an engagement with the length-adjusting shaft.

3. The rotary electronic component according to claim 2, wherein the projection is pressed against an end of the enlarged portion.

4. The rotary electronic component according to claim 2, wherein the enlarged portion is one of a plurality of enlarged portions, and the enlarged portions are formed along the upper groove.

5. The rotary electronic component according to claim 1, wherein the rotary shaft is provided with an engagement groove on a periphery thereof, and the engagement groove extends in a direction axially of the rotary shaft from an end with which the length-adjusting shaft engages;

the length-adjusting shaft has a cylindrical shape, and a projection is disposed on an inside periphery of the length-adjusting shaft so as to meet with the enlarged portion; and the linear section of the fixing member is inserted from a side opposite to the rotary shaft to press the projection against a side wall of the engagement groove.

6. The rotary electronic component according to claim 1, wherein the length-adjusting shaft has a cylindrical shape at least on a side having an engagement with the rotary shaft, and the length-adjusting shaft is provided with an engagement groove, the engagement groove containing a lower groove formed through an inside periphery of the shaft in a direction axially of the shaft, and an enlarged portion extending from the lower groove toward a direction other than the direction axially of the rotary shaft;

a projection is disposed on a periphery of the rotary shaft so as to fit in the enlarged portion; and the linear section is inserted in the engagement groove from a side opposite to the rotary shaft to prevent the projection from moving toward a direction other than the direction axially of the rotary shaft so that the fixing member has an engagement with the length-adjusting shaft.

7. The rotary electronic component according to claim 6, wherein the enlarged portion is one of a plurality of enlarged portions, and the enlarged portions are formed along the lower groove of the engagement groove.

8. A method of manufacturing a rotary electronic component comprising:

A) attaching rotatably a rotary shaft configured to actuate a functional element section to a bearing fixed to a case configured to accommodate the functional element section, so that an end of the rotary shaft protrudes from the bearing;

B) engaging a length-adjusting shaft with the end of the rotary shaft; and

C) inserting a linear section of a fixing member between the rotary shaft and the length-adjusting shaft in a manner that the linear section extends along a direction axially of the rotary shaft so as to engage the rotary shaft with the length-adjusting shaft.

9. The method of manufacturing a rotary electronic component according to claim 8, wherein the rotary shaft is provided with an engagement groove on a periphery thereof, the engagement groove containing an upper groove extending in the direction axially of the rotary shaft from an end with which the length-adjusting shaft engages, and an enlarged portion having an area extending from the upper groove toward a direction other than the direction axially of the rotary shaft;

the length-adjusting shaft has a cylindrical shape, and a projection is disposed on an inside periphery of the length-adjusting shaft; and in said engaging of the length-adjusting shaft with the rotary shaft, the projection is inserted into the upper groove by moving the rotary shaft and the length-adjusting shaft relatively in the direction axially of the rotary shaft and moved into the enlarged portion by rotating the rotary shaft and the length-adjusting shaft relatively, and in said inserting of the linear section of the fixing member between the rotary shaft and the length-adjusting shaft, the linear section is inserted into the engagement groove from a side opposite to the rotary shaft so as to prevent the projection from moving toward a direction other than the direction axially of the rotary shaft.

10. The method of manufacturing a rotary electronic component according to claim 8, wherein the rotary shaft is provided with an engagement groove on a periphery thereof, the engagement groove extends in the direction axially of the rotary shaft from an end with which the length-adjusting shaft engages, the length-adjusting shaft has a cylindrical shape, and a projection is disposed on an inside periphery of the length-adjusting shaft;

in said engaging of the length-adjusting shaft with the rotary shaft, the projection is inserted into the upper groove by moving the rotary shaft and the length-adjusting shaft relatively in the direction axially of the rotary shaft, and in said inserting of the linear section of the fixing member between the rotary shaft and the length-adjusting shaft, the linear section is inserted into the engagement groove from a side opposite to the rotary shaft so as to press the projection against a side wall of the engagement groove.

11. The method of manufacturing a rotary electronic component according to claim 8, wherein the length-adjusting shaft has a cylindrical shape at least on a side having an engagement with the rotary shaft, and the length-adjusting shaft is provided with an engagement groove, the engagement groove containing a lower groove formed through an inside periphery of the shaft in the direction axially of the shaft, and an enlarged portion extending from the lower groove toward a direction other than the direction axially of the rotary shaft;

a projection is disposed on a periphery of the rotary shaft; and in said engaging of the length-adjusting shaft with the rotary shaft, the projection is inserted into the upper groove by moving the rotary shaft and the length-adjusting shaft relatively in the direction axially of the rotary shaft and moved into the enlarged portion by rotating the rotary shaft and the length-adjusting shaft relatively, and in said inserting of the linear section of the fixing member between the rotary shaft and the length-adjusting shaft, the linear section is inserted into the engagement groove from a side opposite to the rotary shaft so as to prevent the projection from moving toward a direction other than the direction axially of the rotary shaft.

* * * * *